United States Patent [19]

Yates

[11] Patent Number: 4,732,214

[45] Date of Patent: Mar. 22, 1988

[54] SUBSEA PRODUCTION TEST VALVE ASSEMBLY

[75] Inventor: Peter D. Yates, Houston, Tex.

[73] Assignee: Baker Oil Tools, Inc., Orange, Calif.

[21] Appl. No.: 2,457

[22] Filed: Jan. 12, 1987

[51] Int. Cl.[4] ..... E21B 34/04; E21B 34/10

[52] U.S. Cl. ..... 166/336; 166/319; 166/340; 166/363; 166/375; 166/386

[58] Field of Search ..... 166/336, 337, 338, 339, 166/340, 344, 386, 374, 375, 332, 363, 321, 319, 323

[56] References Cited

U.S. PATENT DOCUMENTS

| | | | |
|---|---|---|---|
| 3,457,991 | 7/1969 | Sizer et al. | 166/72 X |
| 3,870,101 | 3/1975 | Helmus | 166/363 |
| 3,974,875 | 8/1976 | Herd et al. | 166/337 X |
| 4,320,804 | 3/1982 | Brooks | 166/363 X |
| 4,494,609 | 1/1985 | Schwendemann | 166/363 X |

*Primary Examiner*—Stephen J. Novosad

*Attorney, Agent, or Firm*—Norvell & Associates

[57] ABSTRACT

A subsea test assembly securable in a subsea blowout preventer stack is used in methods for performing wellbore tests and for disconnecting a tubular string from a subsea wellhead. The test valve assembly includes an upper subassembly releasably latched to a lower subassembly. Dog members are latched and unlatched in a corkscrew manner requiring only a slight rotation, and are held in the locked position by an axially movable sleeve. Nominal rotation of the latch within the upper subassembly is required to latch and unlatch the dogs, and a relatively short stroke of the movable sleeve locks and unlocks the dog members. The latch may be hydraulically or mechanically deactivated. The valving of the test assembly preferably comprises a ball member having both a metallic and elastomeric seal for sealing the passageway through the assembly. The elastomeric seal is carried by the ball and engages a metallic sleeve axially movable below the ball for sealing engagement against the ball. The elastomeric seal is made only after the ball is rotated to the closed position, thereby choking off the well. An axially movable piston is manipulated to both hold open a flapper, which acts as a second valve, and cause the ball to move from the opened to the closed position, and then the flapper is permitted to close.

20 Claims, 13 Drawing Figures

SUBSEA PRODUCTION TEST VALVE ASSEMBLY

FIELD OF THE INVENTION

The present invention relates to methods and apparatus for performing wellbore tests on a subsea petroleum recovery well and, more particularly, relates to improved methods and apparatus adapted to be located in a subsea blowout preventer stack for both performing wellbore tests and for disconnecting a tubular string from a subsea wellhead.

BACKGROUND OF THE INVENTION

Prior art subsea test valve assemblies are generally adapted to be located in a subsea blowout preventer stack, and enable removal of tubing and related equipment from a subsea petroleum recovery well. Such assemblies may include an upper subassembly releasably latched to a lower subassembly to permit the drill pipe or tubing string above the test tree to be released from the lower subassembly and components connected thereto, so as to temporarily abandon the well during incumbent weather or other unsafe or undesirable conditions. One or more valves within the lower subassembly, normally open during production of petroleum fluids, are closed prior to the unlatching of the upper subassembly. These valves may be reopened to resume production operations after the drilling vessel returns to the site and the upper subassembly is reconnected to the lower subassembly.

U.S. Pat. No. 3,457,991 discloses an automatic safety valve assembly positioned adjacent the blowout preventers. Fluid pressure from the surface opens a pair of ball valve elements from their biased closed position.

U.S. Pat. No. 3,870,101 discloses a subsea production test valve assembly including one or more pressure activated ball valves, and a latch mechanism for releasably securing the upper subassembly to the lower subassembly containing one or more valves. The pistons controlling the valves are pressure balanced, and the valves are adapted to permit reverse flow around them when in the closed condition. The piston for manipulating the lower valve to the closed position drives a ball, which cuts a wireline extending through the valve which would otherwise hold the valve partially open. The latching mechanism may be hydraulically or mechanically controlled once the ball valves are in the closed position. In order to mechanically release the latch, the tubing string is rotated, unthreading latch fingers within the lower torque sub.

U.S. Pat. No. 4,320,804 discloses another valve assembly suitable for locating in a subsea blowout preventer stack. One ball valve element may be manipulated from a closed to an opened position only subsequent to another ball valve element being manipulated to the fully open position, thereby assuring more efficient cutting of the wireline through the ball valve elements. The latching apparatus comprises first and second rocker sections selectively controlled by a collet shiftable by a piston and a spring. Again, the latch may be hydraulically or mechanically manipulated, which is accomplished in the latter instance by rotating the tubing string until latch fingers are moved away from locking engagement. The stroke of the latching mechanism is approximately 3.5 inches, which inherently increases the length of the assembly and accordingly excludes its utility for certain applications.

SUMMARY OF THE INVENTION

The test valve assembly of the present invention includes an upper subassembly releasably latched to a lower subassembly by a plurality of engaging dog members in each subassembly. Dog members are latched and unlatched in a corkscrew manner requiring only a slight rotation, and are held in the locked position by an axially movable sleeve. Nominal rotation of the latch within the upper subassembly is required to latch and unlatch the dogs, and a relatively short stroke of the movable sleeve locks and unlocks the dog members. The utilization of rigid rather than deflectable latch members substantially increases reliability, and all actuatable portions of the latch are conveniently provided in the upper subassembly. As with prior art latch mechanisms for subsea test assemblies, the latch may be hydraulically or mechanically deactivated.

The valving of the test assembly preferably comprises a ball member having both a metallic and elastomeric seal for sealing the passageway through the assembly. The elastomeric seal is carried by the ball and engages a metallic sleeve axially movable below the ball for sealing engagement against the ball. The elastomeric seal is made only after the ball is rotated to the closed position. The well is desirably choked off as the ball rotates, and the ball is not likely to lock up in the partially open position. An axially movable piston is manipulated to both hold open a flapper, which acts as a second valve, and cause the ball to move from the opened to the closed position, and then permitting the flapper to close.

DETAILED DESCRIPTION OF THE PREFERRED EMBODIMENT

Figure 1:
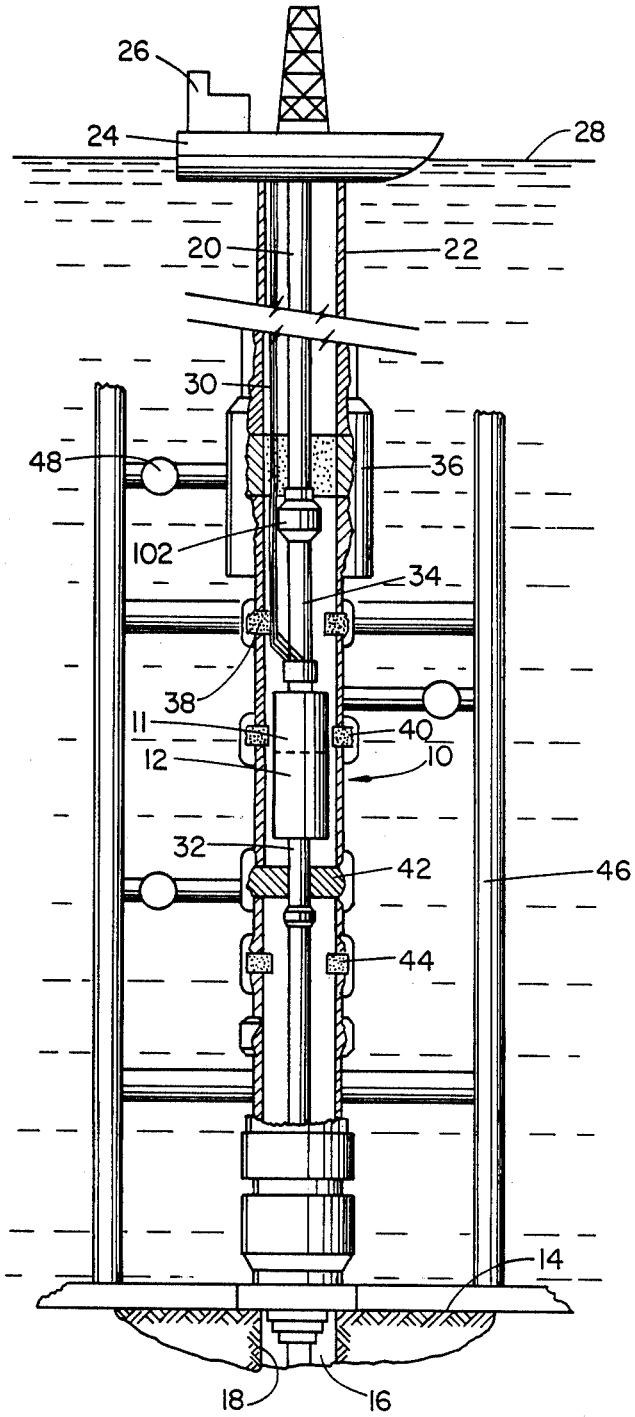
FIG. 1 is a simplified schematic illustration of the apparatus of the present invention affixed to a tubing or drill pipe string and housed within a subsea blowout preventer stack for recovery well.

FIG. 1 depicts the assembly 10 according to the present invention in a suitable environment. As explained below, assembly 10 consists of an upper subassembly 11 containing a latch mechanism, and a lower subassembly 12 containing primary and auxilary valving elements. Assembly 10 communicates with well 16 including casing 18 formed beneath sea bed 14. Assembly 10 typically is landed with a fluted hanger (not shown), and is carried on tubing or drill pipe 20 within a riser 22 extending from below a semisubmersible drilling vessel or drill ship 24 to the ocean surface 28. The tubing or drill pipe 20 continues below the assembly 10 into the well 16 and within the casing 18 as shown. A plurality of control lines 30 extend from a control panel 26 on the vessel or ship to the assembly 10 for manipulation of components within the assembly 10 as explained subsequently. An end portion 102 (discussed subsequently) of handling joint 34 is provided adjacent an upper blowout preventer 36. A plurality of pipe rams 42 and 44 are provided around the tubing or drill pipe 20 for engaging the tubing to control the fluid flow within the blowout preventer stack. A shear ram 38 is provided above assembly 10 for shearing the handling joint 34, if necessary. Blind ram 40 is also provided for extra security to seal the well should the ball and flapper (described subsequently) fail once the upper subassembly is removed.

Figure 2A:
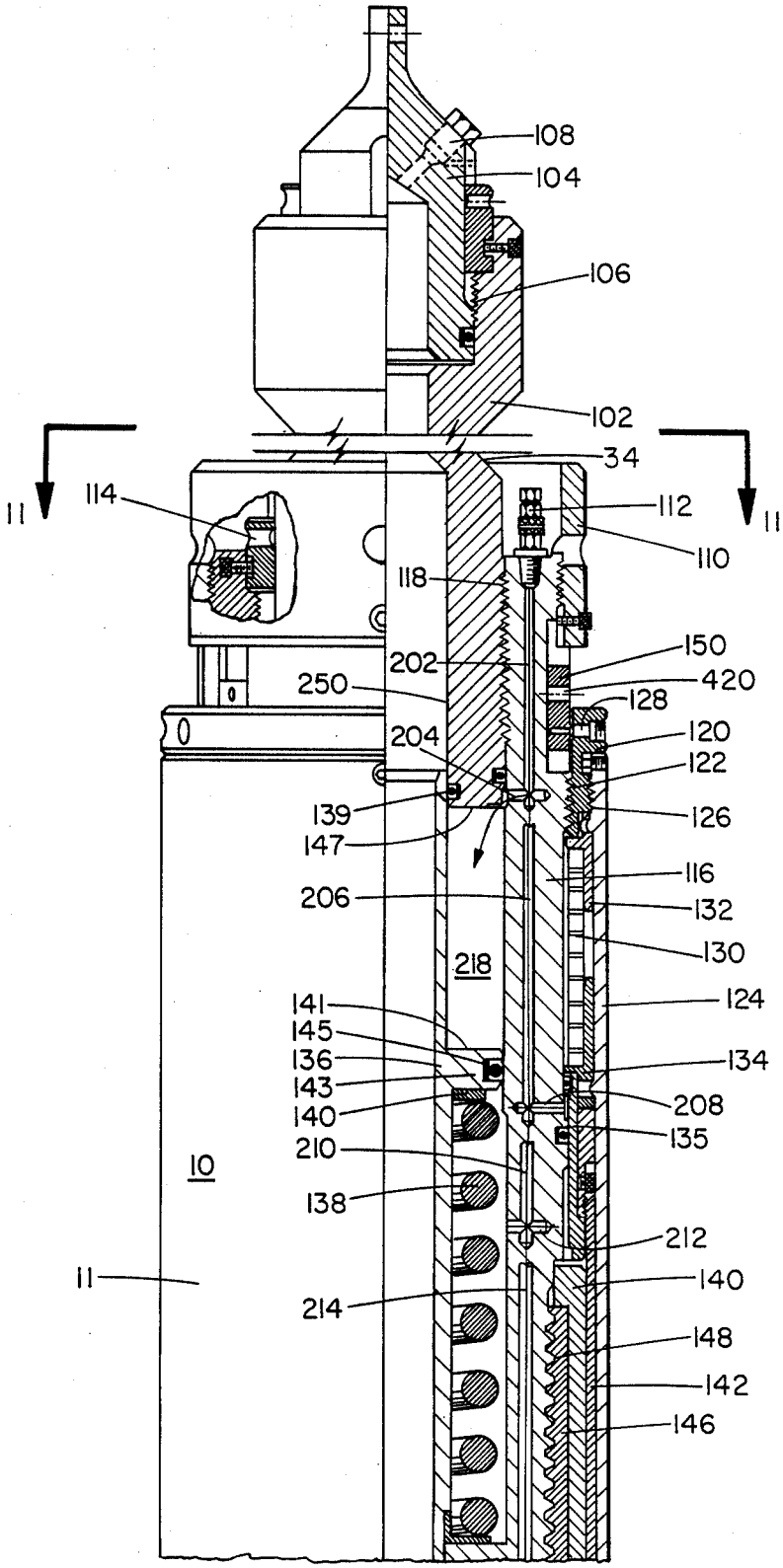
FIGS. 2A and 2B together constitute a longitudinally extending sectional view of the apparatus of the present invention with the latching mechanism in the latch position and the valves in the open position.
Figure 2B:
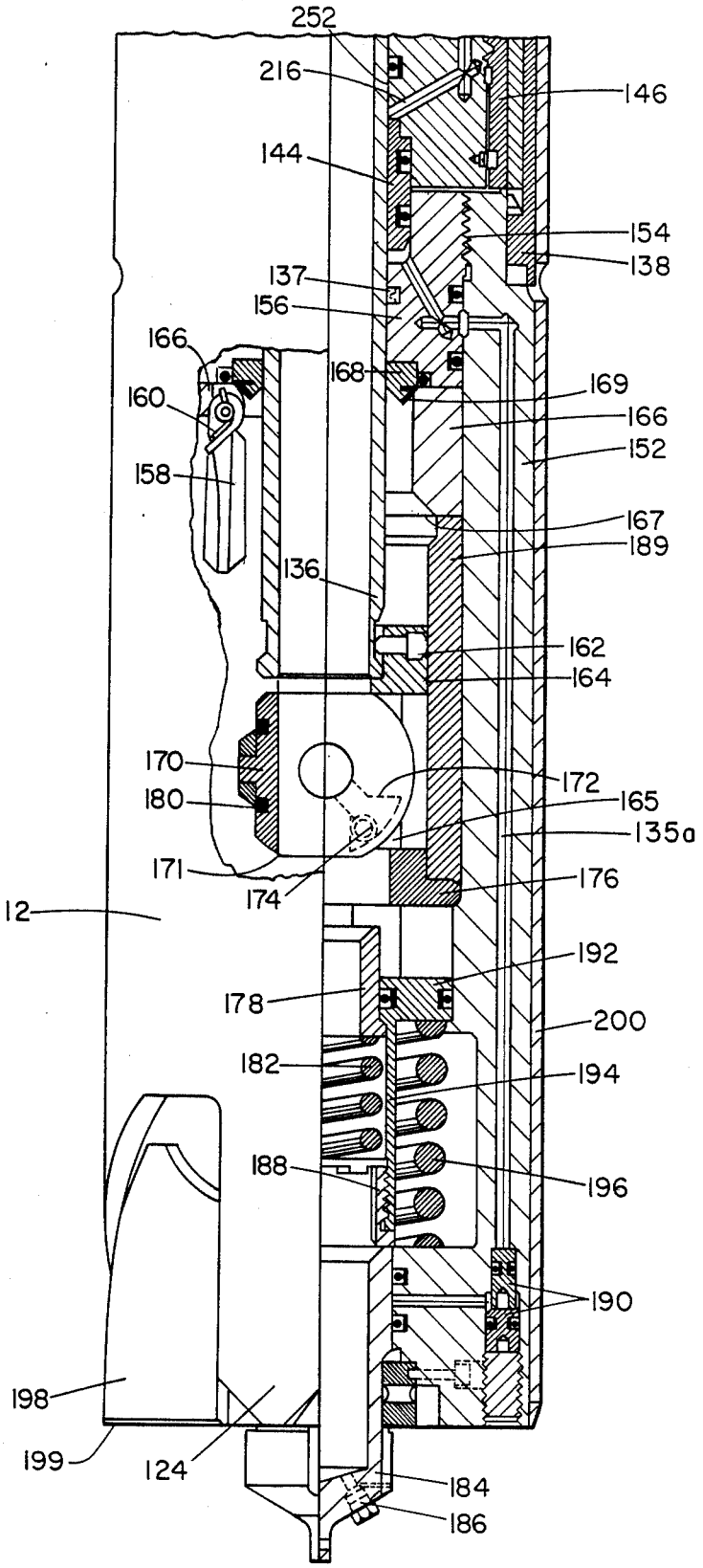

FIGS. 2A and 2B together depict the assembly 10 according to the present invention, comprising an upper subassembly 11 and a lower subassembly 12. The handling joint end portion 102 has bull plug 104 threaded thereto at 106, with the bull plug 104 including a pressure test port 108. The handing joint 34 is connected to the upper housing 116 of assembly 10, which is provided with a plurality of quick disconnects 112. The present invention, and in particular the latching mechanism described subsequently, allows for a relatively short overall length, e.g., 72 inches, between the top of the control line protector housing 110 (see FIG. 2A) and the lower surface 199 (see FIG. 2B) of the assembly 10.

Assembly 10 thus includes an upper housing 116 threaded to handling joint 34 at threads 118. Pin 114 locks the interconnection between the handling joint 34 and the upper housing 116, and is typical of the interconnection lock provided between various threaded components of apparatus 10, although such other standard locking pins are not depicted in the figures. Torque sub 120 is threaded on its interior surface at 122 for engagement with upper housing 116, and is threaded on its exterior surface at 126 for engagement with outer housing 124. Torque sub 120 allows torque, e.g. 18,000 foot pounds maximum, to be applied through the outer housing 124 in order to rotate the upper and lower subassemblies, but upon shearing of torque pins 128, allows the upper housing 116 and handling joint 34 to rotate to the right relative to the torque sub 120 and outer housing 124, thereby mechanically releasing the upper subassembly from the lower subassembly. Shearing plate 150 accepts torque pins 128, and enables torque to be applied in a manner which does not damage the upper housing 116.

Latch spring 130, which may take the form of a wave spring, is bounded by two identical latch spring housings 132 and 134. Latch spring 130 biases latch piston 135 downwardly, and serves to push locking sleeve 142 down to lock the latching mechanism. Latch member 140 in upper subassembly 11 is retained in position by latch retaining ring 146 threaded at 148 to upper housing 116.

Upward movement of the piston 136 raises the ball operator mandrel 164 upward. Piston 136 serves to open and close the ball valve elements within the valve 10, and is biased upwardly by spring 138 to maintain the valve elements closed. Annular sealing ring 144 seals between the upper subassembly 11 and the lower subassembly 12, and latch retaining ring 146 retains the latch 140 in position during assembly. Seal 139 on handling joint 34 provides fluid-tight engagement with piston 136, and stop surface 147 on handling joint 34 engages surface 141 of enlarged portion 143 of piston 136 for limiting upward movement of the piston. Seal 145 carried by portion 143 provides continuous sealing engagement with upper housing 116. Valve retaining sub 156 retains components within the lower housing 152, and seal 137 provides sealed engagement with piston 136 if chemical injection below the tree is anticipated.

Flapper item 158 is normally retained in the open position by piston 136, and is positioned in the closed position for safety by flapper spring 160. The above flapper components are contained within flapper housing 166, which may be placed within the assembly 10 in the manner of a cartridge. In order for the flapper 158 to close, the piston 136 must therefore either be actuated to the closed position as explained hereafter, or may move to its biased closed position due to the failure of pressure to the apparatus 10. Flapper seat 168 provides both an elastomeric and a metal-to-metal seal against flapper housing 166 and flapper item 158 in order to seal the flapper under both low and high differential pressure. Accordingly, piston 136 must be in the uppermost position in order that the flapper item 158 may close.

Operating pin 174 rotates ball 170 through an arm 165 on the ball operator mandrel 164. Pin 174 is thus trapped in slot 172 of the ball, and serves to actuate the ball into the opened and closed positions. Power springs 138 (see FIG. 2A) and 196 (see FIG. 2B) serve to bias the ball 170 in the closed position. Washers 145 are provided between spring 138 and piston 136 and upper housing 116, respectively. When the piston 136 moves upward, mandrel latch dog 162 applies an upward force to ball 170 through operator mandrel 164 and pin 174 sufficient to cut a solid wireline, a braided wireline or a conducting electric line passing through the ball, so that the ball may fully close. Rotation of the ball 170 with respect to the cutter plate 176 also enables the ball to cut $1\frac{1}{4}''$ or smaller diameter coil tubing (not shown) passing through the apparatus 10 and the ball 170. Cutter plate 176 is fixedly secured to ball operator housing 189, which in turn is secured to lower housing 152. A portion of the ball 170 opposite seal element 180 is removed (although the removed portion is not shown in FIG. 2B), thus obtaining a U-shaped ball with a central passageway open as shown in FIG. 2B, with the bore at the U-shaped configuration containing the sealing members for the ball 170 and the side portions of the U-shaped configuration containing the slots 172 for receiving the pin 174. This configuration prevents double cutting of the coil tubing or wireline when the ball 170 is moved to the closed position. Ball operator mandrel 164 thus contains legs (one leg 165 shown in FIG. 2B) for carrying ball operator pin 174 in order to obtain a camming action at cutting edge surface 171 against plate 176.

Figure 3:
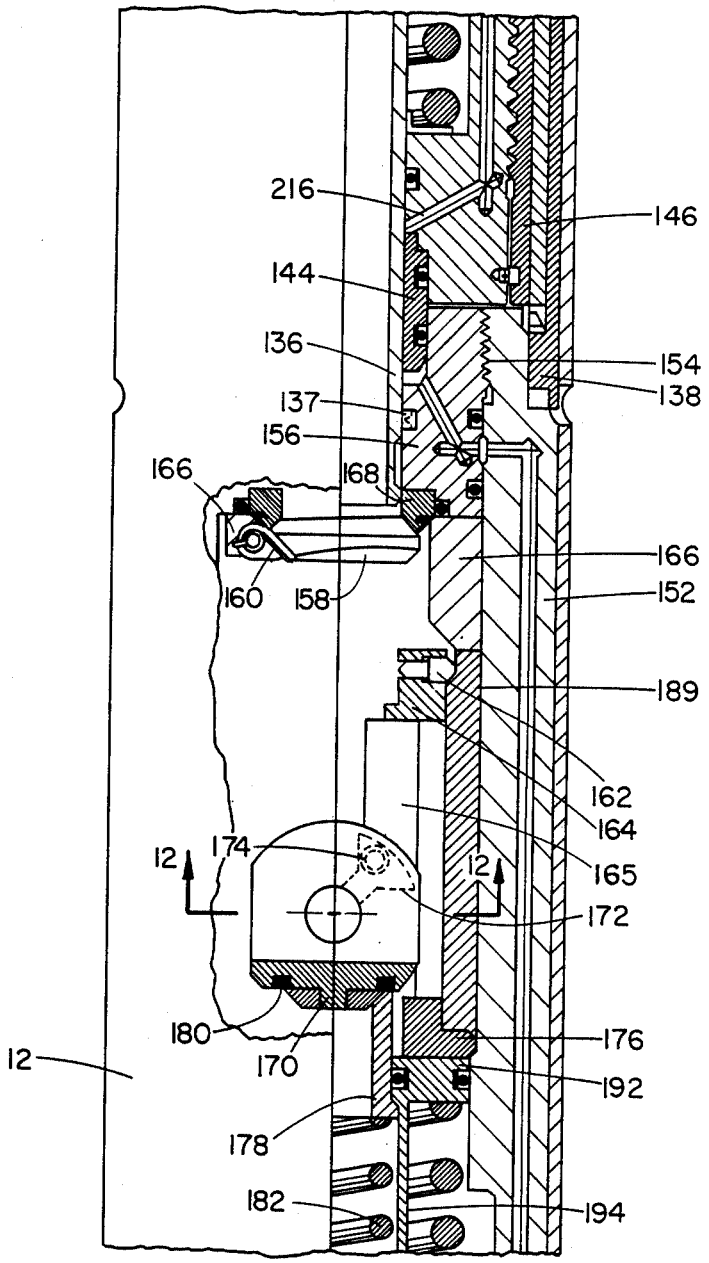
FIG. 3 is a longitudinally extending sectional view of a portion of the apparatus depicted in FIGS. 2A and 2B with the valves in the closed position.

In order to seal the ball 170, sealing sleeve 178 moves upward against sealing element 180, as shown in FIG. 3. Sealing sleeve spring 182 biases sealing sleeve 178 into engagement with the ball 170, and spring retainer 188 retains spring 182 in position. The design of the sealing sleeve 178 and the ball 170 is similar in many respects to that disclosed in U.S. Pat. No. 3,870,101, hereby incorporated by reference. Sealing element 180 is thus provided on the ball 170, and seals with sleeve 178 when the ball 170 is rotated so that the element 180 is on a lower surface of the ball 170.

Ball operator mandrel 164 includes a lower portion 192 affixed thereto for sealed engagement between the sealing sleeve 178 and the lower housing 152. End portion 194 is threaded at its lower end for engagement with retaining ring 188, and is biased upwardly by operator spring 196. Spring 196, together with spring 138, assists in closing the ball 170 prior to the unlatching operation.

The interrelationship between the components operating the flapper 158 and the components operating the ball element 170 is one of the features of the present invention. Piston 136 engages mandrel latch dogs 162, which in turn carry ball operator mandrel 164 which causes the manipulation of the ball 170 to the opened and the closed positions. When the piston 136 moves upwardly, the dogs 162 are carried with the piston 136 until the shoulder on lower portion 192 of the ball operator mandrel 164 engages the shoulder on the cutter plate 176. When this occurs, the mandrel latch dogs 162 disengage from the piston 136, and the piston 136 continues to move upwardly until it contacts the lower end of handling joint 34, allowing the flapper item 158 to close. Thus, the same components which are used to maintain the flapper item 158 in the open position also are used to manipulate the ball 170 to the opened and closed positions and, upon disengagement, permit the flapper 158 to close.

Lugs 198 on the lower portion of subassembly 12 are provided for applying torque to the torque pins 128 in the upper subassembly 11. Bull plug 184 is interconnected to the lower subassembly 12, and includes a port 186 for pressure testing. Plugs 190 are utilized to plug off the passageway 135*a* for chemical injection and, as explained subsequently, upper plug 190 may be removed at the surface depending on the desired location for the chemical injection. The entirety of the components in the lower subassembly 12 are housed within outer housing 124.

The operation of the assembly 10 will now be described with reference to FIGS. 2A, 2B, 3, 4 and 5. The assembly 10 is typically lowered into the well with the latching mechanism in the latch position, and the ball 170 and flapper item 158 in the open position. The assembly is normally tested on the surface prior to running into the well, and once the apparatus has landed, the well may be tested in conventional fashion. Pressure from the surface through one of the lines 30 is applied to passageway 202 and 204, increasing the pressure in chamber 218 until the piston 136 is either forced downward to the position shown in FIG. 2B or retained in the downward position. Pressure in chamber 218 thus keeps the ball 170 and the flapper item 158 in the open position.

Figure 4:
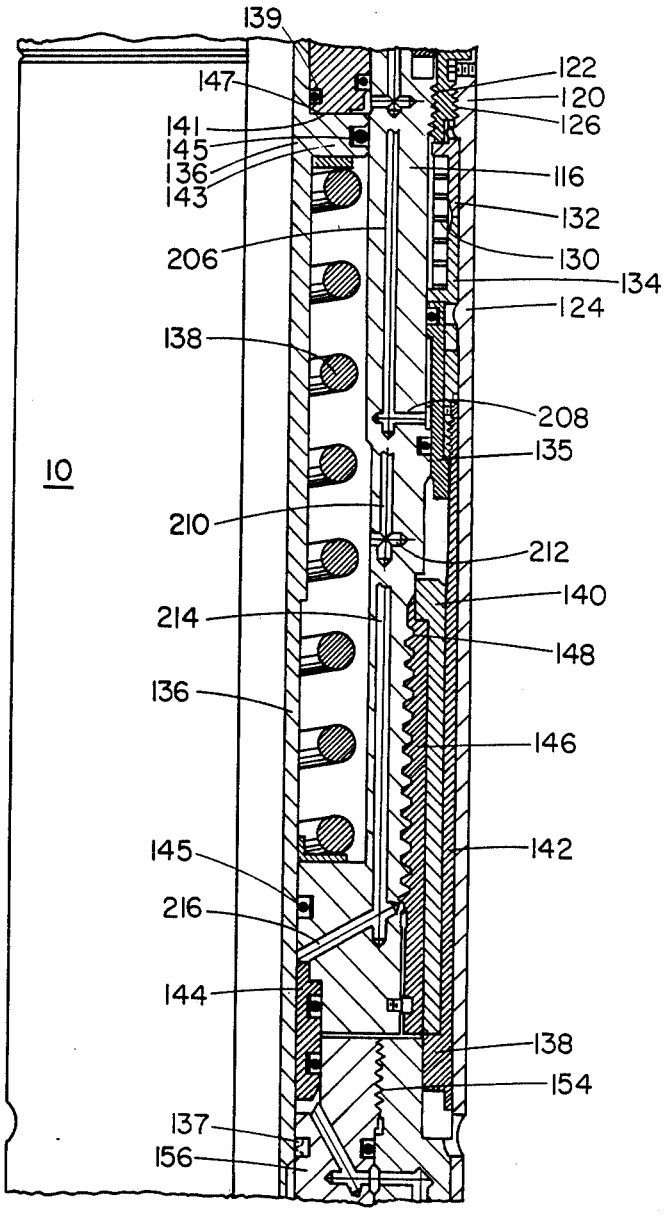
FIG. 4 is a longitudinally extending sectional view of a portion of the apparatus depicted in FIG. 2A and 2B with the latching mechanism in the unlatch position, but with the upper subassembly not yet separated from the lower subassembly.

In order to move the ball 170 and the flapper 158 to the closed position, pressure is released in line 204, and piston springs 138 and 196 force the piston 136 upward to the position shown in FIGS. 3 and 4, with surface 141 of the piston 136 in engagement with surface 147 of handling joint 34. Although not necessary, the piston 136 could also be moved to the position shown in FIGS. 3 and 4 by pressuring up one of the control lines 30 to increase pressure in passageways 210 ahd 212, thereby exerting an upward force on the lower surface of the portion 143 of the piston 136.

As previously noted, upward movement of piston 136 carries the ball operator mandrel 164 upward through dogs 162, rotating the ball 170 counterclockwise from the position shown in FIG. 2B to the position shown in FIG. 3, causing knife edge 171 of the ball to cut any coiled tubing or cable (not shown) passing through the ball 170 by engagement with the cutter plate 176. When the lower portion engages the cutter plate 176, dogs 162 release mandrel 164 from the piston 136, and the piston 136 continues its upward movement to the position shown in FIGS. 3 and 4, allowing the flapper item 158 to seal against metallic flapper seat 168 and the elastomeric seal 169 carried by the seat 168.

Ball operator mandrel 164 includes a lower portion 192 connected thereto, which prevents sealing sleeve 178 from moving upward until piston 136 first moves upward as described above. As mandrel 164 moves upward, the ball 170 will be rotated to the fully closed position, and thereafter lower portion 192 engages the cutter plate 176. Sealing sleeve spring 182 thus cannot force sealing sleeve 178 into engagement with seals 180, as shown in FIG. 3, until the ball 170 is in the fully closed position. With the ball 170 and flapper item 158 closed and sealed, the unlatching operation may be commenced.

In order to unlatch the latching mechanism of the present invention, pressure from the surface may be applied through passageways 206 and 208, forcing the latch piston 135 upward from the position shown in FIG. 2A to the position shown in FIG. 4, thereby compressing the spring 130. Movement of the latch piston 135, in turn, pulls up locking sleeve 142 in the position as shown in FIG. 4 in order to unlock the upper subassembly 11 from the lower subassembly 12. Thereafter, pickup on the upper subassembly 11 will, due to the geometry of the dog members, automatically unlatch subassembly 11 from subassembly 12 by a corkscrewing operation.

Figure 5:
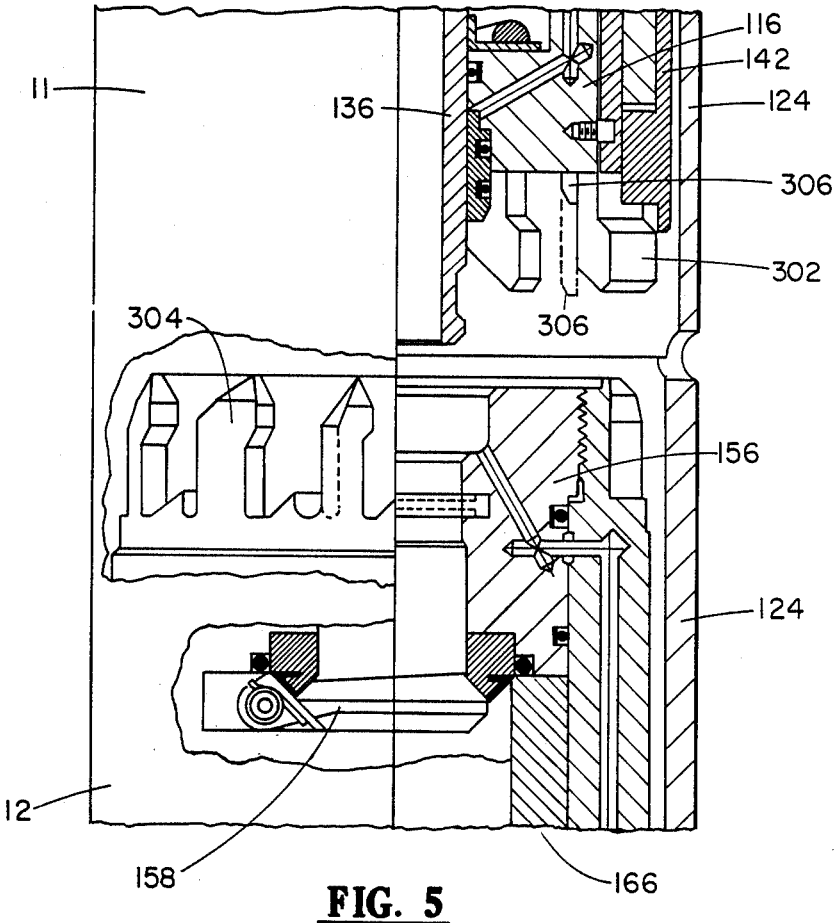
FIG. 5 is a longitudinally extending sectional view, partially cut-away, of a portion of the apparatus depicted in FIGS. 2A and 2B with the latching mechanism in the unlatch position, and with the upper subassembly partially separated from the lower subassembly.

With pressure remaining in passageways 206 and 208 and with latch spring 130 compressed, an upward force may be exerted on the upper subassembly 11 so that the upper subassembly 11 is released from the lower subassembly 12. Once unlatched, fluid pressure in the piston 135 may be released, allowing the locking sleeve 142 return to its biased downward position. The valve and sealing devices in assembly 10 are thus left downhole to secure the well, and the tubing or drill pipe string and apparatus above subassembly 11 may be removed from the well, and the drill ship or floating vessel maneuvered to another location. FIG. 5 depicts the lower portion of the upper subassembly 11 released from the lower subassembly 12. The travel of the locking sleeve 142 required to unlock the latching mechanism is comparatively short, e.g., 1½". This is shown in FIG. 5 by the position of key 306 relative to the upper housing 116 in the unlock position, compared to the position of key 306 in the lock position as shown by dashed lines.

Figure 6:
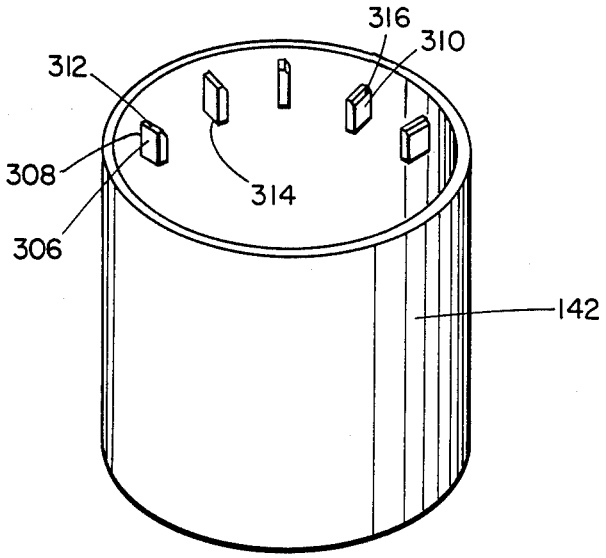
FIG. 6 is a pictorial view of the locking sleeve shown in FIGS. 2A and 2B.
Figure 7:
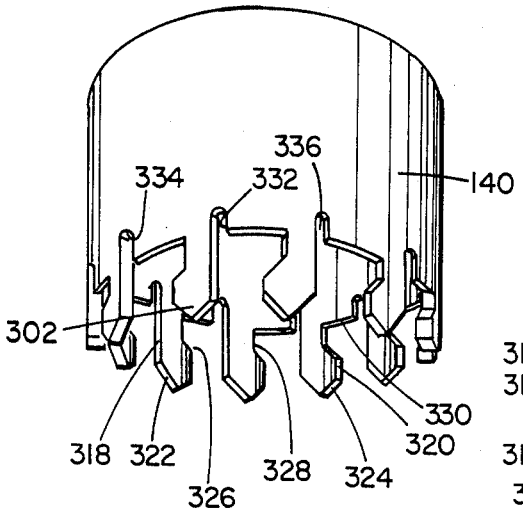
FIG. 7 is a pictorial view of a portion of the latch according to the present invention, illustrating the latching dog members of the upper subassembly.

The latching mechanism of the present invention is shown in greater detail in FIGS. 6–10. Referring first to FIG. 7, the latch 140 includes a plurality of dog members 302, each extending from and lying within the cylindrical configuration of the body of the latch 140. Each of the dogs 302 includes a vertical key engaging surface 318 and an opposing vertically positioned dog engaging surfaces 320 and 328. Slanted dog engaging surface 326 interconnects surfaces 320 and 328, and acts to prevent unlatching of the upper and lower subassemblies when the key is in the latched position. Slanted surfaces 322 and 324 define the boundaries for the tip end of the dog members 302, and assist in interfitting the dog members of the upper and lower subassemblies.

FIG. 6 depicts the locking sleeve 142 including a plurality of keys 306 which may be formed as an integral part of the cylindrical shaped body of sleeve 142. Each of the keys 306 includes vertically positioned and opposing dog engaging surfaces 308 and 310, as well as a horizontally positioned tip end 312 and slanted surface 316 interconnecting surfaces 310 and 312. It should be understood that locking sleeve 142 as shown in FIG. 6 is upside down compared, for example, to the sleeve 142 shown in FIGS. 4 and 5, and accordingly end surface 314 of key 306 is the upper surface of the key.

Figure 8:
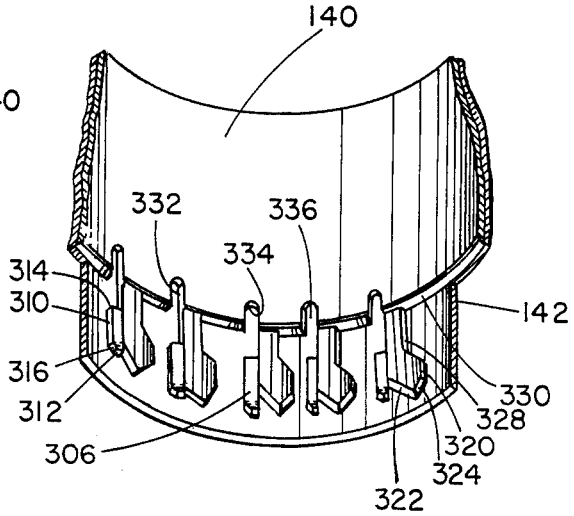
FIG. 8 is a pictorial cross-sectional view illustrating the relationship between the locking sleeve and the latching dog members of the upper subassembly when in the latch position.
Figure 9:
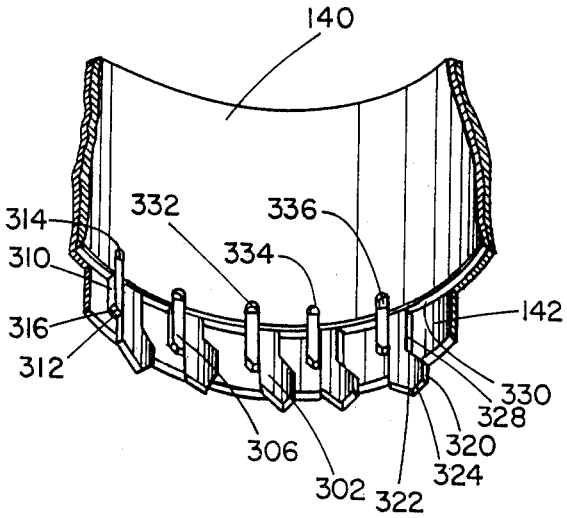
FIG. 9 is a pictorial cross-sectional view illustrating the relationship between the locking sleeve and the latching dog members of the upper subassembly when in the unlatch position.

FIG. 8 depicts the latch 140 of the present invention with the locking sleeve 142 in the locked position relative to the latch 140. As previously explained, locking sleeve 142 may move axially relative to the latch 140, and therefore keys 306 may move axially in sliding engagement with surfaces 318 of dog member 302 and 332 of latch 140 (adjacent slot 336), so that upper surface 314 of key 306 engages and approaches slot end surface 334 when in the unlock position. FIG. 9 depicts the locking sleeve 142 and keys 306 in the unlocked position with respect to latch 140 and dog members 302. Since the dog members 304 are a fixed component of the lower housing 152, the latching mechanism is activated and deactivated by moving dogs 302 and keys 306 relative to the lower housing 152. Thus, all movable components of the latching mechanism are retrieved to the surface with subassembly 11.

Figure 10:
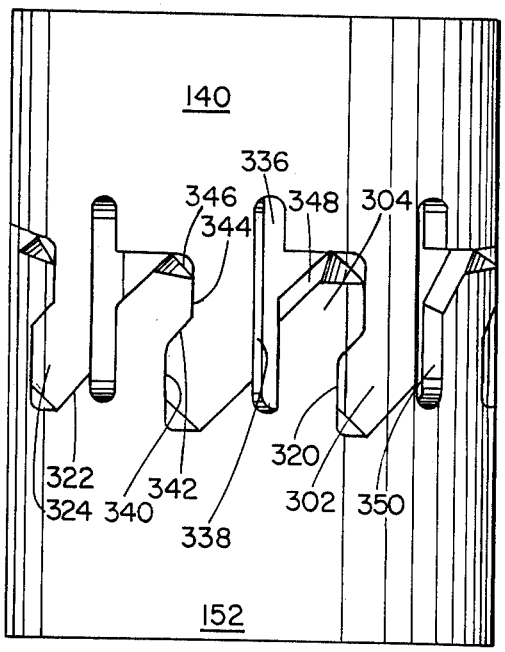
FIG. 10 is a pictorial view of the latching dog members of the upper and lower subassemblies in the latch position, with the locking sleeve removed for clarity.

FIG. 10 depicts the relationship between the dog members 302 of latch 140 and the dog members 304 of the lower housing 152 in the latched position, with the keys of the locking sleeve 142 removed for clarity. In operation, the keys 306 move within the slots 336 to lock and unlock the upper subassembly 11 from the lower subassembly 12. Also, FIG. 10 depicts that the dogs 304 of the lower housing 152 contain surfaces 340, 344, and 350 for mating engagement with the dogs 302. The tip end of each of the dogs in housing 152 is bounded by slanted surfaces 346 and 348.

In order to reconnect the upper subassembly to the lower subassembly in a subsea environment, the upper subassembly may be landed with a guide (not shown) onto the lower sub assembly while fluid pressure in line 208 holds locking sleeve 142 in the upward or unlock position. Rotational positioning of the upper subassembly relative to the lower subassembly is not critical, since the dogs 302 may become interconnected with any of the dogs 304 in the lower subassembly. As shown in FIGS. 7 and 10, the tapered surfaces 322, 324, and 326 of dogs 302 are preferably each angled at a 45° deflection angle, and will automatically position the upper subassembly onto the lower subassembly. The surfaces 342 of the dog members 304 for mating engagement with surfaces 326 are also preferably at this same 45° deflection angle. The upper subassembly 11 will thus naturally become positioned as shown in FIG. 10 as the latch which is part of the upper subassembly is lowered onto the lower subassembly. Thereafter, pressure may be reduced in passageway 208, which will allow the keys 306 to move from the position shown in FIG. 9 to the position shown in FIG. 8, locking the subassemblies together. Once the keys 306 have moved downward, dogs 302 and 304 are locked together and cannot become disengaged until the keys 306 are again moved upwardly to the unlock position.

According to one embodiment of the present invention, the internal diameter 250 of the handling joint 34 is slightly less than the internal diameter 252 of the upper housing 116. A ⅛" diameter variation is sufficient to cause a pressure differential across the piston 136 to move or retain the piston 136 in the upper position independent of spring 138 or, alternatively, as a backup to spring 138. Because of this diameter variation, a sufficient force is present to overcome seal friction and quickly close the flapper 158 and the ball 170 if equal pressure exists on both ends of the piston 136 and in the absence of springs 138 or 196. The piston 136 thus closes the ball 170 and allows the flapper 158 to close but does not retain the ball 170 and flapper 158 closed.

The locking mechanism of the present invention may thus be activated by a relatively short stroke, e.g., 1½", of the locking sleeve 142. Radial deflection of the locking members is not utilized, and rotational movement of dogs 302 relative to dogs 304 economizes the required stroke of the locking keys 306. Rotation of locking members rather than deflection of locking members is utilized, and all movable components of the locking mechanism are contained within the upper subassembly and may thus be checked prior to reassembly.

In the event that fluid pressure to assembly 10 is lost, it is still possible to disengage the upper subassembly 11 from the lower subassembly 12. Referring again to FIGS. 2A and 2B, the handling joint 34 and upper housing 116 torqued to the right, causing torque pins 128 to shear. Subsequent rotation of the upper housing 116 approximately 3½ turns will then unthread threads 122 from the upper housing 116, thereby enabling the locking sleeve 142 to be mechanically raised and keys 306 moved to the unlock position for releasing the dogs 302 from the dogs 304. Thus, a relatively small number of turns is required to unlatch the upper subassembly from the lower subassembly, which may be of vital importance during an emergency.

Figure 11:
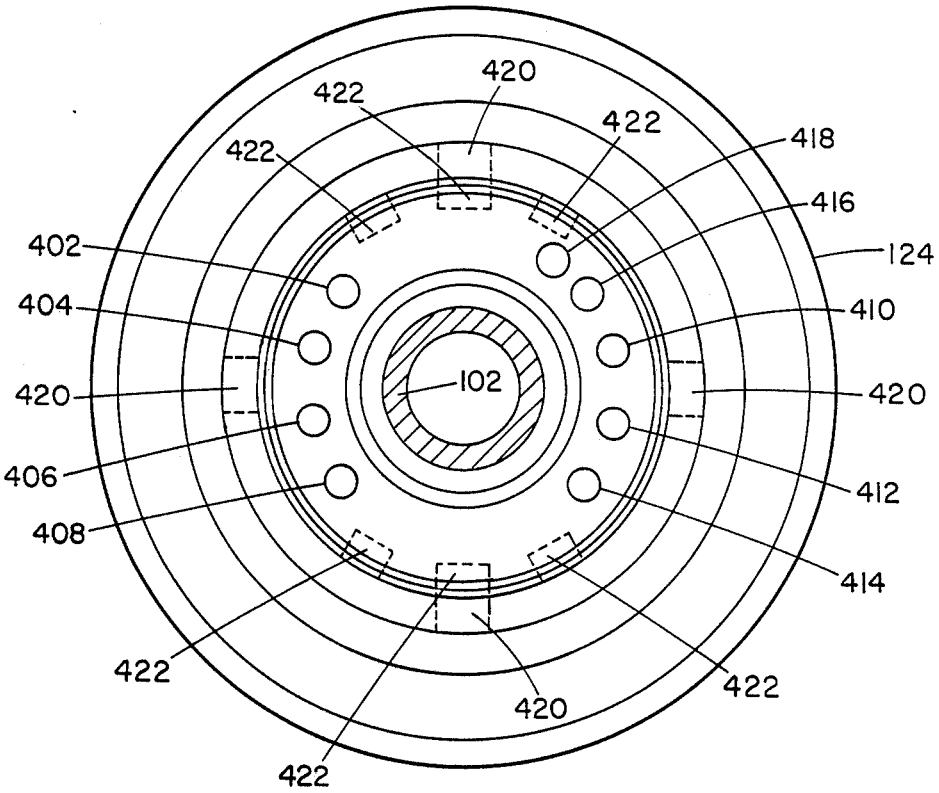
FIG. 11 is a cross-sectional view of the apparatus shown in FIGS. 2A and 2B.

Referring now to FIGS. 11, 2A and 2B, ports 402 and 414 and lines 206 and 208 serve to transmit pressure to push or retain latch piston 135 in the unlatch position. Ports 404 and 412 and lines 202 and 204 may be pressurized to force piston 136 to the open position. Ports 406 and 410 and lines 210 and 212 may be utilized to forcefully rotate the ball to the closed position to cut the wireline or tubing. Port 408 and lines 214, 216 and 135*a* may be utilized for chemical injection of a fluid, such as a corrosion inhibitor, at various points within the subsea test tree. Ports 416 and 418 are extra or dummy ports for supplemental lines (not shown).

The user will know the selected location of the chemical injection prior to lowering the assembly 10 into the well, and according to a first option, the upper plug 190 may be removed, and the bull plug 184 will be removed and replaced with gun-drilled slick joint 32 (see FIG. 1). The desired chemical may then be injected past the apparatus 10 and into the formation at a point below the apparatus 10. Alternatively, the seal 137 may be removed and the upper plug 190 left in place. In this case, the chemical fluid enters the tubing above the ball valve 170. If the flapper 158 is closed, fluid will then be injected above the flapper 158. An advantage of the embodiment described herein is that the same housing may be utilized for various chemical injection options.

In FIG. 11 it should be understood that each of the ports 402, 404, 406 and 408 may be used as an input port, while ports 410, 412 and 414 are bleed ports for corresponding input lines. Four ports 420 shown in dashed lines are equally spaced about the upper housing, and provide for passage of fluid into and out of the protector housing 110. Six keyways 422 indicate the relative position of the torque pin 128 previously disclosed.

Figure 12:
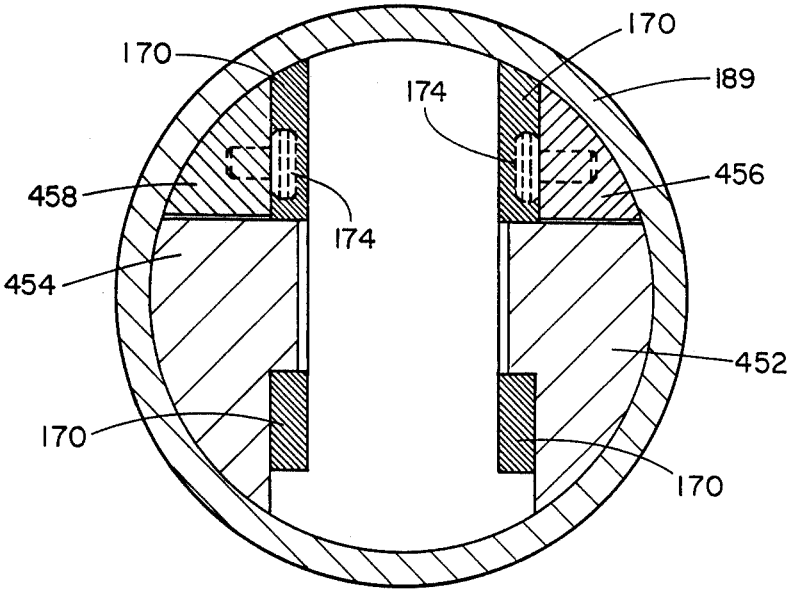
FIG. 12 is a cross-sectional view of the ball mechanism of the apparatus according to the present invention.

FIG. 12 is a horizontal cross-sectional view through the center of ball 170 in the closed position. As previously noted, the ball 170 comprises a pair of plate-like legs as shown having apertures for receiving projections of the cutter plate 176. Cutter plate 176 is formed by right-hand segment 452 and left-hand segment 454, which segments together form the stop for the lower portion 192 of the ball operator mandrel 164, as shown in FIG. 3. Ball 170 is interconnected to ball operator mandrel portions 456 and 458 with pins 174, as previously described. The relationship of the ball 170 and ball operator housing 189 is depicted in FIG. 12. The relative position of the pins 174 are shown in dashed lines, although such pins are above the horizontal centerline plane of the ball 170 when in the closed position.

Although the invention has been described in terms of the specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirt of the described invention.

What is claimed and desired to be secured by Letters Patent is:

1. In a subsea test assembly securable within a blowout preventer stack above a subterranean well and positionable between upper and lower portions of a tubular conduit in fluid communication with a production zone within the well, the test assembly including an upper subassembly carriable with the upper conduit portion, a lower subassembly carriable with the lower conduit portion, and valve means in the lower subassembly manipulatable between opened and closed positions to control fluid flow within the conduit, the improvement comprising:

the upper subassembly including an upper housing and first rigid dog means fixedly secured to the upper housing;

the lower subassembly including a lower housing and second rigid dog means fixedly secured to the lower housing;

the first rigid dog means positionable between a latch position for latching the upper and lower subassemblies and an unlatch position for unlatching the upper and lower subassemblies upon rotational movement of the first dog means with respect to the second dog means; and lock means axially movable relative to the first and second dog means from a lock position for limiting rotational movement of the first dog means with respect to the second dog means to an unlock position for allowing the first dog means to rotate relative to the second dog means and unlatch the upper subassembly from the lower subassembly.

2. The apparatus as defined in claim 1, wherein said first dog means comprises a first plurality of downwardly extending dog members circumferentially spaced about a lower portion of the upper housing; and the second dog means comprises a second plurality of upwardly extending dog members circumferentially spaced about an upper portion of the lower housing.

3. The apparatus as defined in claim 2, wherein each of said first and second dog members have tapered mating surfaces for locking engagement with a corresponding dog member.

4. The apparatus as defined in claim 1, further comprising:

fluid transmission means for transmitting fluid pressure from the surface to said apparatus;

piston means slidably movable within the upper subassembly with respect to the first dog means in response to the fluid pressure;

biasing means acting upon the piston means for biasing the piston means in a lock position; and interconnection means interconnecting the piston means and the lock means for moving the lock means from a lock position to an unlock position in response to the fluid pressure from the surface to the piston means.

5. The apparatus as defined in claim 2, wherein tip end surfaces of both the first and second plurality of dog members are tapered for facilitating latched engagement of said dog members.

6. The apparatus as defined in claim 2, wherein:

each of the first and second plurality of dog members lie within a sleeve-shaped configuration; and said locking means in radially fixed relative to the first and second plurality of dog members and is movably responsive to fluid pressure from the surface to the upper subassembly.

7. The apparatus as defined in claim 1, wherein all components of the first dog means, the second dog means, and the lock means movable with respect to the lower housing are carried by the upper subassembly.

8. The apparatus as defined in claim 4, further comprising:

releasable interconnect means within the upper subassembly responsive to a selected torque between the upper subassembly and the lower subassembly for allowing axial movement of the lock means relative to the first dog means upon application of an upward force to the upper conduit portion.

9. In a subsea test assembly securable within a blowout preventer stack above a subterranean well and positionable between upper and lower portions of a tubular conduit in fluid communication with a production zone within the well, the test assembly including an upper subassembly carriable with the upper conduit portion, a lower subassembly carriable with the lower conduit portion, and valve means including a rotatable ball valve member and a pivotable flapper member in the lower subassembly each manipulatable between opened and closed positions for controlling fluid flow within the conduit, the improvement comprising:

the upper subassembly including an upper housing and a first plurality of rigid downwardly extending dog members fixedly secured to the upper housing;

the lower subassembly including a lower housing and a second plurality of rigid upwardly extending dog members fixedly secured to the lower housing;

the first plurality of dog members each being positionable between a latch position for latching the upper and lower subassemblies and an unlatch position for unlatching the upper and lower subassemblies upon rotational movement of the first plurality of dog members with respect to the second plurality of dog members; and an axially movable fluid responsive piston member movable from an open valve position to a closed valve position for structurally engaging the flapper member upon movement from the closed valve position to the opened valve position to open the flapper and retain the flapper member open when in the open valve position;

ball operating means interconnecting the piston member and the ball valve member for rotating the ball valve member between opened and closed positions in response to movement of the piston member; and locking means movable relative to the second plurality of dog members from a lock position for limiting rotational movement of the first plurality of dog members with respect to the second plurality of dog members to an unlock position for allowing the first plurality of dog members to rotate relative to the second plurality of dog members and unlatch the upper subassembly from the lower subassembly.

10. The apparatus as defined in claim 9, further comprising:

first biasing means for biasing the piston member in the closed position; and second biasing means for biasing the flapper member in the closed position.

11. The apparatus as defined in claim 9, wherein the ball operating means is disengagable from the piston member after the ball valve member is moved from the opened position to the closed position for permitting further axial movement of the piston member to disengage the flapper member.

12. The apparatus as defined in claim 11, further comprising:

an axially movable sleeve operatively interconnected with the ball operating means;

sleeve biasing means for biasing the sleeve into engagement with the ball valve member; and elastomeric sealing means carried on the ball valve member for sealing engagement with the sealing sleeve after the ball valve member has been moved to the closed position.

13. The apparatus as defined in claim 9, wherein each of said first and second dog members have tapered mating surfaces for locking engagement with a corresponding dog member.

14. The apparatus as defined in claim 9, wherein:

each of the first and second plurality of dog members lie within a sleeve-shaped configuration; and said locking means is axially movable and radially fixed relative to the first and second plurality of dog members and is movably responsive to fluid pressure from the surface to the upper subassembly.

15. A method of operating a subsea test assembly securable within a blowout preventer stack above a subterranean well and positionable between upper and lower portions of a tubular conduit in fluid communication with a production zone within the well, the test assembly including an upper subassembly carriable with the upper conduit portion, a lower subassembly carriable with the lower conduit portion, and valve means in the lower subassembly manipulatable between opened and closed positions to control fluid flow within the conduit, the method comprising:

fixedly securing a first plurality of rigid dog members to an upper housing of the upper subassembly;

fixedly securing a second plurality of rigid dog members to a lower housing of the lower subassembly;

axially and rotatably moving the upper housing relative to the lower housing for latching the first plurality of dog members to the second plurality of dog members;

thereafter axially moving a locking member relative to latched first and second dog members for locking the first plurality of dog members to the second plurality of dog members and retaining the upper subassembly latched to the lower subassembly.

16. The method as defined in claim 15, further comprising:

biasing a slidable piston member in the upper subassembly in a lock position;

interconnecting the slidable piston member and the locking member; and passing fluid pressure from the surface to the slidable piston member to move the piston member from a lock to an unlock position.

17. The method as defined in claim 16, further comprising:

closing the valve means to the closed position;

retaining the piston member in an unlock position;

raising the upper subassembly axially relative to the lower subassembly to unlatch the upper subassembly from the lower subassembly; and thereafter retrieving the upper subassembly and upper conduit portion to the surface while the lower subassembly and lower conduit portion remain in position.

18. The method as defined in claim 15, further comprising:

providing as the valve means a rotatable ball valve member and an auxiliary valve member;

providing an axially movable piston member in the upper subassembly;

moving the axially movable piston downward to structurally engage the auxiliary valve member and open the auxiliary valve member; and thereafter releasably engaging the piston member and the ball member to rotate the ball member to an opened position while the piston member is moving downward.

19. The method as defined in claim 18, further comprising:

biasing the piston member in the closed position;

biasing the auxiliary valve member in the closed position;

moving the piston member upward to rotate the ball member from an opened to a closed position;

thereafter releasably disengaging the piston member and ball member after the ball member has moved to the closed position; and thereafter further moving the piston member upward allowing the biased auxiliary valve member to move to the closed position.

20. The method as defined in claim 15, further comprising:

providing an axially movable sleeve beneath the ball member;

moving the piston member upward to rotate the ball member from an opened to a closed position; and thereafter allowing the sleeve to sealingly engage the ball member.

* * * * *